US008044327B2

(12) United States Patent
Azpiritxaga et al.

(10) Patent No.: US 8,044,327 B2
(45) Date of Patent: Oct. 25, 2011

(54) DYNAMIC TEMPERATURE SENSOR DEVICE

(75) Inventors: Jon Endika Azpiritxaga, Durango (ES); Igor Barreno, Mondragón (ES); Josu Leturia, Lekeitio (ES)

(73) Assignee: Eika, S. Coop, Etxebarria (Bizkaia) (ES)

( * ) Notice: Subject to any disclaimer, the term of this patent is extended or adjusted under 35 U.S.C. 154(b) by 902 days.

(21) Appl. No.: 12/074,803

(22) Filed: Mar. 6, 2008

(65) Prior Publication Data

US 2008/0217318 A1 Sep. 11, 2008

(30) Foreign Application Priority Data

Mar. 8, 2007 (ES) ..... 200700513 U

(51) Int. Cl.
*H05B 3/68* (2006.01)

(52) U.S. Cl. ..... 219/448.11; 219/460.1

(58) Field of Classification Search ..... 219/446.1, 219/447.1, 448.11, 448.14, 460.1; 374/183, 374/185

See application file for complete search history.

(56) References Cited

U.S. PATENT DOCUMENTS

| | | | | |
|---|---|---|---|---|
| 4,447,710 | A * | 5/1984 | McWilliams | 219/448.14 |
| 7,030,342 | B2 * | 4/2006 | McWilliams | 219/460.1 |
| 7,186,954 | B2 * | 3/2007 | Wilkins | 219/448.11 |
| 7,652,229 | B2 * | 1/2010 | Alves et al. | 219/448.11 |
| 2003/0072352 | A1 | 4/2003 | Muziol | |

FOREIGN PATENT DOCUMENTS

WO WO2004111589 A1 12/2004

* cited by examiner

*Primary Examiner* — Sang Paik
(74) *Attorney, Agent, or Firm* — Tim L. Kitchen; Peter B. Scull; Berenbaum Weinshienk PC

(57) ABSTRACT

Temperature sensor device inserted into a radiant heater (1) that incorporates at least one heating resistance (2) and is adapted to a glass ceramic cooking hob (4), comprising a film-type resistive sensor element (11) with metal wires (12) for its connection to terminals (18) and a support element (13) that passes through the radiant heater (1), at least in part. The sensor element (11) is inserted into the free end of said support element (13) so that the top and bottom faces are exposed in relation to said support element (13), and the sensor device also comprises an insulating element (14) disposed beneath the sensor element (11), separated from the support element (13) at least in the area in which the sensor device passes through the radiant heater (1).

12 Claims, 2 Drawing Sheets

DYNAMIC TEMPERATURE SENSOR DEVICE

TECHNICAL FIELD

The present invention relates to a temperature sensor device inserted into an electrical radiant heater adapted to a glass ceramic cooker unit.

PRIOR ART

There are known temperature detection devices adapted to glass ceramic cooker units for the measuring of the temperature of the bottom of the cooking vessel disposed on the glass ceramic cooking plate, up to 300° C., or for the limiting of the safety temperature of said cooking plate. The most widely used temperature devices are those including Pt sensors, with a Pt-wire tubular probe, expandable-rod or of the type thick-film.

The measuring of the temperature of the bottom of the vessel may be direct in the event that the temperature sensor is in contact with the cooking hob, which usually causes problems given that the interior surface of the cooking hob is an irregular surface, or indirect, in the event that the temperature detection device is situated between the cooking hob and heat-radiating elements of the heaters, without contact with the cooking hob.

As they are located inside the radiant heaters, the temperature detection devices of the hob or cooking vessel are usually subjected to direct radiation originating from one or more radiant elements of the heaters, which requires the insulation of the sensor elements of the temperature detection devices from said radiations, obstructing the dynamic response of the sensor, as said sensor is not able to distinguish rapidly the small temperature variations originating on the cooking hob.

WO2004/111589 discloses a temperature sensor device for a radiant heater that comprises a thin flat substrate with a first surface provided with a resistive temperature sensor element with electrical connecting wires, and a second surface. A support member has a first surface adapted to receive the aforementioned flat substrate with the second surface juxtaposed to it. Insulating means are interposed between the second surface of the substantially flat substrate and the support member in at least one region in which is disposed the temperature sensor.

US 2003/0072352 A1 describes a temperature sensor disposed in the space between the cooking hob and the radiant heating elements, which has at least one sensor element enclosed, at least partially, in a protective housing made of ceramic material. The sensor element is provided with electrical connection cables guided through the housing to the exterior, said sensor being fixed to the protective casing. The temperature sensor is of the type resistive of film containing at least one metal comprised in the platinum metals group.

DISCLOSURE OF THE INVENTION

It is the object of the present invention to provide a cooking hob temperature sensor device as disclosed in the claims.

The temperature sensor device inserted into a radiant heater with at least one heating resistance, which is adapted to a glass ceramic cooking hob, comprises a film-type resistive sensor element with metal wires for its connection to terminals, a support element that passes through, at least in part, the radiant heater, and an insulating element disposed beneath the sensor element. Said sensor element is inserted under pressure into the free end of the support element disposed on the interior of the radiant heater, so that the top and bottom faces of the sensor element are exposed in relation to said support element. In addition, the support element is separated from the insulating element at least in the area in which the sensor device passes through the radiant heater.

In this way, the sensor element is insulated from most of the unwanted heat radiation originated from the radiant resistances of the heater or from elements with thermal inertia, which may cause false readings. The insulating element is separated from the support element, thereby preventing a possible transmission of heat and thermal inertia between both elements that would negatively impact on a dynamic response of the sensor element, particularly when the temperature of the cooking hob falls, as said sensor element is not capable of detecting said fall rapidly.

These and other advantages and characteristics of the invention will be made evident in the light of the drawings and the detailed description thereof.

DETAILED DISCLOSURE OF THE INVENTION

Figure 2:
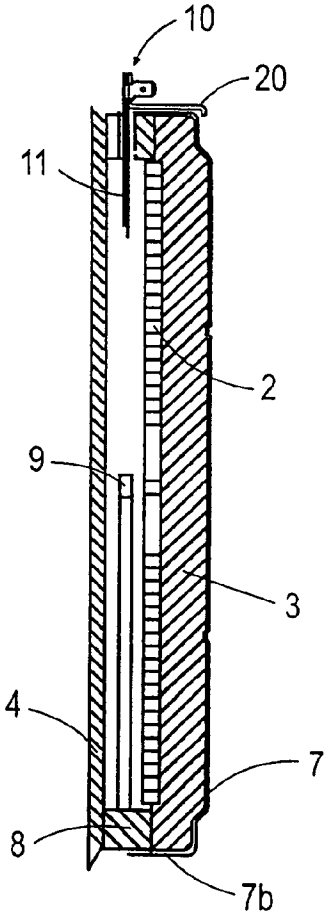
FIG. 2 is a cross-section of the radiant heater of FIG. 1 according to section II-II.
Figure 1:
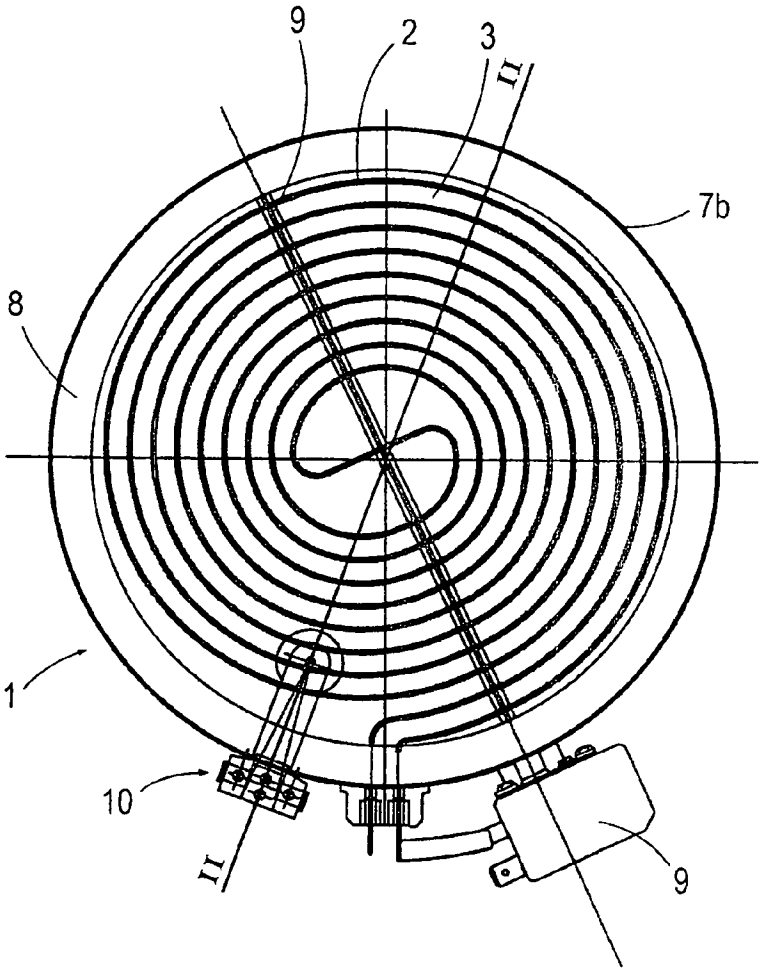
FIG. 1 is a plan view of a first embodiment of the invention in which a radiant heater with a temperature sensor device is shown.

FIGS. 1 and 2 show a preferred embodiment of a radiant heater 1, adapted for a glass ceramic cooking hob 4 that incorporates a temperature sensor device 10 that rapidly detects the temperature variations of the cooking hob 4, providing a reliable reading of the temperature of the cooking hob 4, and therefore the cooking vessel disposed on said cooking hob 4.

The radiant heater 1 is formed by a metal cover 7 with the shape of a circular vessel with a vertical wall 7*b* of a certain height, a circular insulating base 3, of a thermal and electrical insulating material, fitted into the bottom of the metal cover 7, a series of heating resistances 2 fixed onto said insulating base 3, said heating resistances 2 being of any known type, such as wire in the shape of a spiral, band or elongated metal strip, etc, a peripheral insulating hoop 8 supported on the insulating base 3 and which connects to the interior surface of the cooking hob 4, and a temperature limiter device 9 of the elongated-probe type connected to a control.

The cooking vessel, not shown, is heated by means of the radiant heater 1, a temperature proportional to that of said vessel being monitored by the temperature sensor device 10, which is situated between the insulating base 3 of the radiant heater 1 and the cooking hob 4 adjacent to said cooking hob 4, without said sensor device 10 coming into direct contact with said cooking hob 4.

In this preferred embodiment, the temperature sensor device 10, shown in FIGS. 3-7, comprises a film-type resistive sensor element 11 with a pair of metal wires 12 for its connection to terminals 18 that enable said sensor element 11 to be connected electrically to a temperature evaluating and controlling circuit, not shown, a support element 13 that houses said sensor element 11 tightly in one end, so that the top and bottom surfaces of said sensor element 11 are not covered by said support element 13, said sensor element 11 being fixed to the support element 13 by a thin layer of ceramic adhesive, and an insulating element 14 disposed beneath the sensor element I1. The support element 13 and the sensor element 11 are kept separate from the insulating element 14, at least in the area in which the sensor device 10 passes through the radiant heater 1.

The sensor element 11 is a resistance temperature detector of the platinum PT1000 type. It may also comprise, however, another resistance device of similar characteristics.

Figure 6:
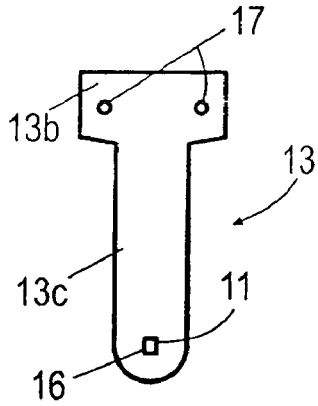
FIG. 6 is a plan view of the support element of the temperature sensor device shown in FIG. 1.

The support element 13, shown in FIG. 6, has an elongated part 13*c* that passes through the radiant heater 1 extending itself on the heating resistances 2, and on the free end of which it has a through hole 16 into which the platinum resistance sensor element 11 is inserted under pressure, and a rectangular base 13*b*, disposed on the exterior of the radiant heater 1, which has two fixing holes 17 symmetrically aligned in relation to the axial axis of the elongated part 13*c*, onto which are riveted the fast-on terminals 18.

The support element 13 is made of a thermal and electrical insulating material, such as mica, and is also light, its thickness being around 0.5 mm.

Figure 7:
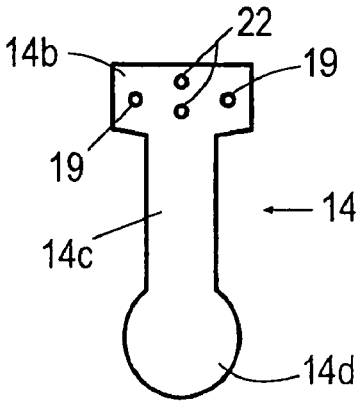
FIG. 7 is a plan view of the insulating element of the temperature sensor device shown in FIG. 1.

The insulating element 14, shown in FIG. 7, has a similar geometry to that of the support element 13, with an elongated part 14*c* that passes through the radiant heater 1, extending itself on the heating resistances 2 beneath the support element 13, parallel to said support element 13, and a rectangular base 14*b*, disposed on the exterior of the radiant heater 1, which has two connection holes 19, symmetrically aligned in relation to the axial axis of the elongated part 14*c*, through which the insulating element 14 is fixed directly to the terminals 18 and the support element 13. The insulating element 14 also has, on the end of the elongated part 14*c*, a circular surface 14*d* of a diameter greater than the width "d" of the elongated part 13*c*, into which is inserted the sensor element 11, so that beneath the sensor element 11 is disposed a greater surface 14*d* insulating from the heat radiation originated from the heating resistances 2. The insulating element is made of a thermal and electrical insulating material with opacifying characteristics, such as mica, being of a thickness of around 0.5 mm.

The temperature sensor device 10 is fixed to the radiant heater 1 by means of a metal bracket 20, the vertical side 20*b* of which includes an assembly hole 21 through which the temperature sensor device 10 is fixed to the vertical wall 7*a* of the radiant heater 1, by means of a threaded fixing device, not shown. The horizontal side 20*c* of the bracket includes two holes 22 aligned for their fixing to the base 14*b* of the insulating element 14 by means of rivets. There may, however, be other means of fixing the temperature sensor device 10 to the vertical wall 7*a* of the metal strip 7 of the heater which are not shown. Consequently, the bracket 20, instead of including two holes 22 aligned on the horizontal side 20*c*, may have the free end bent towards the exterior of the bracket 22 and parallel to said horizontal side 20*c* forming a clip by means of which the respective bases 13*a* and 14*a* of the support element 13 and insulating element 14 are clipped against the horizontal side 20*c*. In other examples, the vertical side 20*b*, instead of having an assembly hole 21, may include a flexible tab that would be inserted into the interior part of the vertical wall 7*b*, the rest of the vertical wall 20*c* of the bracket 20 being supported on the exterior part of the vertical wall 7*b*. The flexible tab would include a second locking tab that would be inserted into housing in the vertical wall 7*b* that would act as a locking element preventing accidental disassembly.

Figure 3:
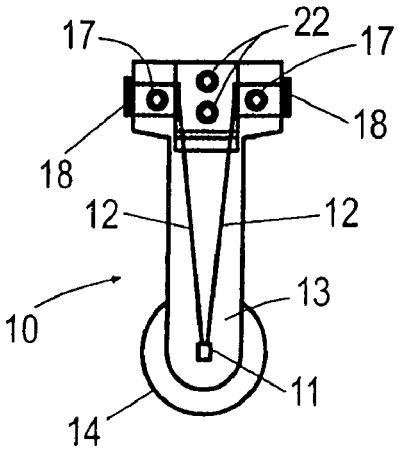
FIG. 3 is a plan view of the temperature sensor device shown in FIG. 1.
Figure 4:
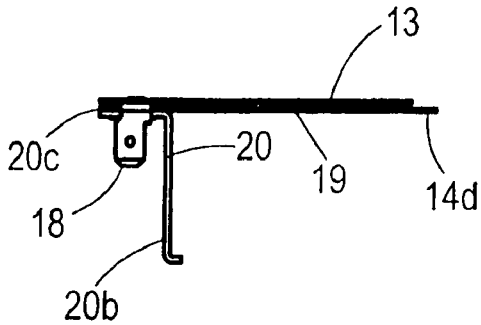
FIG. 4 is a lateral view of the temperature sensor device shown in FIG. 1.
Figure 5:
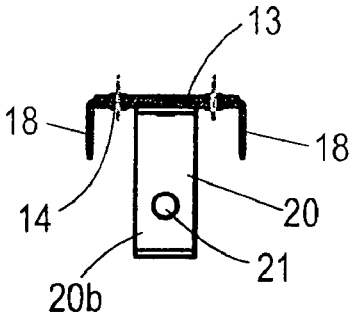
FIG. 5 is a front view of the temperature sensor device shown in FIG. 1.
Figure 8:
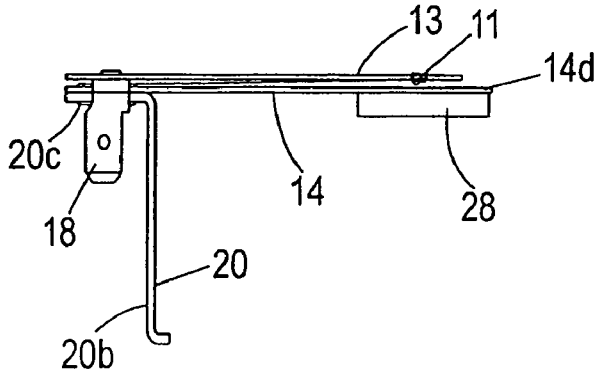
FIG. 8 is a lateral view of a second embodiment of the temperature sensor device.

In a second embodiment of the invention, shown in FIG. 8, and with the objective of improving the insulation of the sensor element 11 from the radiation originating from the heating resistances 2, a disc 25 of an insulating microporous-type material is added, which is fixed to the bottom part of the circular surface 14*d* of the insulating element 14 shown in FIGS. 3 and 7.

What is claimed is:

1. A temperature sensor device inserted into a radiant heater which incorporates at least one heating resistance and is adapted to a glass ceramic cooking hob, comprising a film-type resistive sensor element with top and bottom faces and with metal wires for its connection to terminals and a support element that passes through the radiant heater at least in part, wherein said sensor element is inserted in the free end of said support element so that the top and bottom faces of the sensor element are exposed in relation to said support element, and wherein the sensor device also comprises an insulating element disposed beneath the sensor element, separated from the support element at least in the area in which the sensor device passes through the radiant heater.

2. The temperature sensor of claim 1, wherein the support element is adjacent to the cooking hob.

3. The temperature sensor device of claim 1, wherein the support element has an elongated part that passes through the radiant heater extending itself on the heating resistances, and a base disposed on the exterior of the radiant heater onto which the terminals are fixed.

4. The temperature sensor device of claim 3, wherein the insulating element has an elongated part that passes through the radiant heater extending itself beneath the support element, and a base disposed on the exterior of the radiant heater onto which the terminals are fixed.

5. The temperature sensor device of claim 4, wherein the insulating element includes a substantially circular surface on the free end of the elongated part, disposed beneath the sensor element.

6. The temperature sensor device of claim 5, wherein the substantially circular surface is of a diameter greater than the width of the elongated part of the support element into which the sensor element is inserted.

7. The temperature sensor device of claim 6, wherein the insulating element has an insulating disc fixed onto the substantially circular surface exposed to the heating resistances.

8. The temperature sensor device of claim 7, wherein the insulating disc is made of a microporous material.

9. Temperature sensor device according to claim 1, wherein the sensor element is a resistive platinum sensor.

10. Temperature sensor device according to claim 9, wherein the sensor element is a PT1000-type sensor.

11. Temperature sensor device according to claim 1, wherein the support element and the insulating element are made of a thermal and electrical insulating material.

12. Temperature sensor device according to claim 11, wherein the support element and the insulating element are made of mica.

* * * * *